US005782731A

United States Patent [19]

Köhn et al.

[11] Patent Number: 5,782,731

[45] Date of Patent: Jul. 21, 1998

[54] METHOD FOR CHECKING THE CORRECT MANUFACTURE OF CROSS BOTTOM VALVE SACKS

[75] Inventors: Uwe Köhn, Osnabrück; Rainer Henze, Lengerich, both of Germany

[73] Assignee: Windmoeller & Hoelscher, Lengerich/Westf., Germany

[21] Appl. No.: 593,409

[22] Filed: Jan. 29, 1996

[30] Foreign Application Priority Data

Jan. 30, 1995 [DE] Germany ..... 195 02 830.9

[51] Int. Cl.[6] ..... B31B 49/04

[52] U.S. Cl. ..... 493/16; 493/11; 493/14; 493/15; 53/53

[58] Field of Search ..... 493/3, 8, 10–20; 53/53

[56] References Cited

U.S. PATENT DOCUMENTS

| | | | |
|---|---|---|---|
| 2,527,295 | 10/1950 | Belcher et al. | 493/16 |
| 2,818,003 | 12/1957 | Browning et al. | 493/11 |
| 2,897,730 | 8/1959 | Browning | 493/11 |
| 2,902,906 | 9/1959 | Paul | 493/11 |
| 3,433,135 | 3/1969 | Lokey et al. | 493/16 |
| 3,524,389 | 8/1970 | Stork | 493/16 |
| 3,537,359 | 11/1970 | Finke | 493/11 |
| 3,581,629 | 6/1971 | Wiendieck | 493/13 |
| 3,583,296 | 6/1971 | Stork | 493/16 |
| 3,643,552 | 2/1972 | Stork | 493/16 |
| 3,646,856 | 3/1972 | Worndl | 493/3 |
| 3,749,632 | 7/1973 | Gibbons | 493/20 |
| 4,582,506 | 4/1986 | Milsmann et al. | 493/19 |

FOREIGN PATENT DOCUMENTS

| | | |
|---|---|---|
| 1293012 | 4/1969 | Germany . |
| 1611647 | 12/1971 | Germany . |
| 2107251 | 8/1972 | Germany . |
| 1511035 | 9/1974 | Germany . |
| 1122788 | 8/1968 | United Kingdom . |

*Primary Examiner*—Michael J. Carone
*Assistant Examiner*—Darren Ark
*Attorney, Agent, or Firm*—Evenson, McKeown, Edwards & Lenahan, P.L.L.C.

[57] ABSTRACT

For manufacturing cross bottom valve sacks, the ends of continuously transported tubular sections are opened out with the formation of so-called "bottom squares" with triangular corner folds lying opposite each other. A valve leaf or a valve tube is tacked onto one side of an opened-out bottom square in such a way that, after the side folds of the opened-out bottom have been folded-in with a mutual overlap, the leaf forms a valve tube leading into the inside of the sack, and with its outer end freely accessible at one side of the sack bottom. For checking the correct position of the valve leaves or of the valve tube, the valve leaf or the valve tube, or the zone of the corner fold, covered thereby when the leaf is tacked in its correct position, is provided with a mark that can be registered by a photocell device fixed to the frame. The photocell device is activated by a reference pulse when, in the manufacturing installation, the sack bottom has reached its predetermined position to be checked. Sacks with an incorrect position of their valve tubes or leaves are eliminated.

15 Claims, 1 Drawing Sheet

METHOD FOR CHECKING THE CORRECT MANUFACTURE OF CROSS BOTTOM VALVE SACKS

FIELD OF THE INVENTION

The invention concerns a method for checking the correct manufacture of cross bottom valve sacks, wherein the ends of continuously conveyed tubular sections are opened out with the formation of so-called bottom squares having triangular side folds lying opposite each other, and a valve leaf is tacked 10 onto one side of an opened out bottom square in such a way that after the side folds of the opened out bottom square have been folded in with a mutual overlap, the leaf forms a valve tube leading into the inside of the sack whose outer end is freely accessible at one side of the bottom.

PRIOR ART

Usually, the valve leaves are tacked in their correct positions onto the opened out sack bottom by spots of adhesive, or adhesive deposits in a desired formatted form. During the subsequent folding-in of the corner folds, when the fold edges are defined by straps or folding plates or folding knives, the valve leaves may become distorted, in particular when residues of the adhesive stick to the means for folding-in the side folds. If, during manufacture, the valve leaf or valve tube becomes distorted during the folding of the side folds, or during the conveying to a processing station down the line, inaccurately glued-in valve leaves will be obtained so that during the subsequent filling of the sacks these cannot be fitted on the filling nozzle of a sack-filling apparatus, or at least not fitted in their correct position, which may result in the fill drapping onto the floor or into the filling machine.

OBJECT OF THE INVENTION

It is, therefore, the object of the invention to create a method of the kind indicated at the outset which ensures that only sacks with correctly glued filler valves leave the sack manufacturing machine.

SUMMARY OF THE INVENTION

In accordance with the invention this problem is solved, in a method as set out above in the Field of the Invention, in that the valve leaf or valve tube, or the zone of the corner fold covered by the valve leaf or valve tube if it is correctly tacked in position, is provided with a mark that can be registered by a photocell device fixed to the frame, in that the photocell device is activated by a reference pulse when the sack bottom in the manufacturing installation has reached its predetermined position which is to be checked, and in that sacks with an incorrect position of their valve tubes or valve leaves are eliminated.

In the method in accordance with the invention, the photocell device registers the position of the valve leaf or valve tube at the time of its activation by the reference pulse which at this time, when the sack bottom or sack workpiece is situated in its position to be checked, must correspond to a predetermined position when the valve leaf or valve tube has been arranged in its correct position and has not subsequently been displaced.

The photocell device registering the valve tubes or valve leaves can of course be adjusted relative to the frame to match different sack or sack bottom formats. The photocell device serving for the check is then only fixedly arranged in the frame with respect to the particular format to be checked on each occasion.

The reference pulse can be generated by the control unit of the machine itself. For example rotating machine components, such as cog wheels or guide wheels or drive wheels of the conveyor belts, may generate pulses in predetermined angular positions by means of attached cams or marks, which pulses correspond to the respective positions to be checked on the basis of the geometry of the machine.

The reference pulse can also be generated by a mechanical feeler which responds to parts or edges of the passing sack bottom or sack workpiece.

Provision may be made for the reference pulse to be generated by a second photocell device which registers the tip or a side edge of the sack bottom, or which responds to (i) a different edge of the sack bottom, or to (ii) a mark arranged on the sack bottom, the sack workpiece or the corner fold. In this design the second photocell device, together with the first photocell device registering the correct position of the glued-in valve tube, forms a kind of template, in which arrangement the photocell devices are arranged in a pattern registering the correct position of the valve tube. The above mentioned marks arranged on the corner fold and/or the valve leaf or the valve tube can be colour fields, with a predetermined position and size, which have to be registered by the first photocell device. In this arrangement, an incorrect position of the valve tube, leading to an elimination of the respective sacks via conventional reject shunts, may be indicated by a response of the first photocell device or even by an absence of its response.

Expediently, at least the first photocell device is a reflecting photocell device which, for example, need not respond at the time of the activation of the second photocell device if the zone of the corner fold covered by the valve tube is coloured dark or black, so that no reflected signal is received, and a defect message is given. Correspondingly it is, of course, also possible to provide the valve tube with coloured marks which are only registered, or not registered, in the correct position of the valve tube.

Provision may be made for several of the first photocell devices to be provided for registering the or each mark indicating the correct position. These multiple photocell devices permit a more accurate acquisition of the correct position of the valve tube.

The zone of the corner fold covered in the correct position by the valve tube can expediently be provided with a colour marking, for example a black field.

BRIEF DESCRIPTION OF THE DRAWINGS

One example of an embodiment of the invention will be explained in greater detail below, with reference to the accompanying drawings, in which.

DETAILED DESCRIPTION OF THE PREFERRED EMBODIMENT

Figure 1:
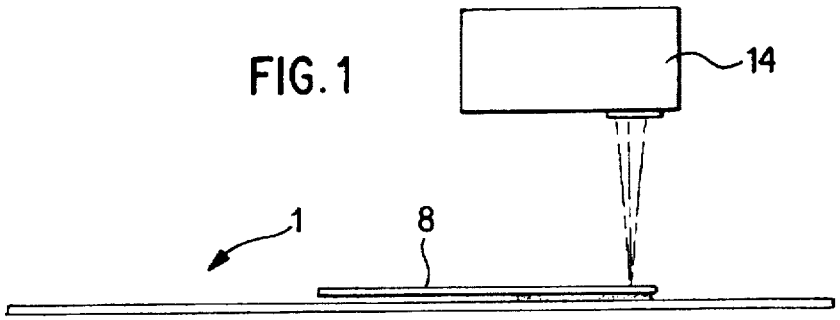
FIG. 1 is an elevational view of one end of the bottom of a sack with a closed cross bottom, being continuously conveyed in a sack manufacturing machine, not shown, and in which view the side folds of the closed bottom covering the inserted valve tube have been omitted for greater clarity.
Figure 2:
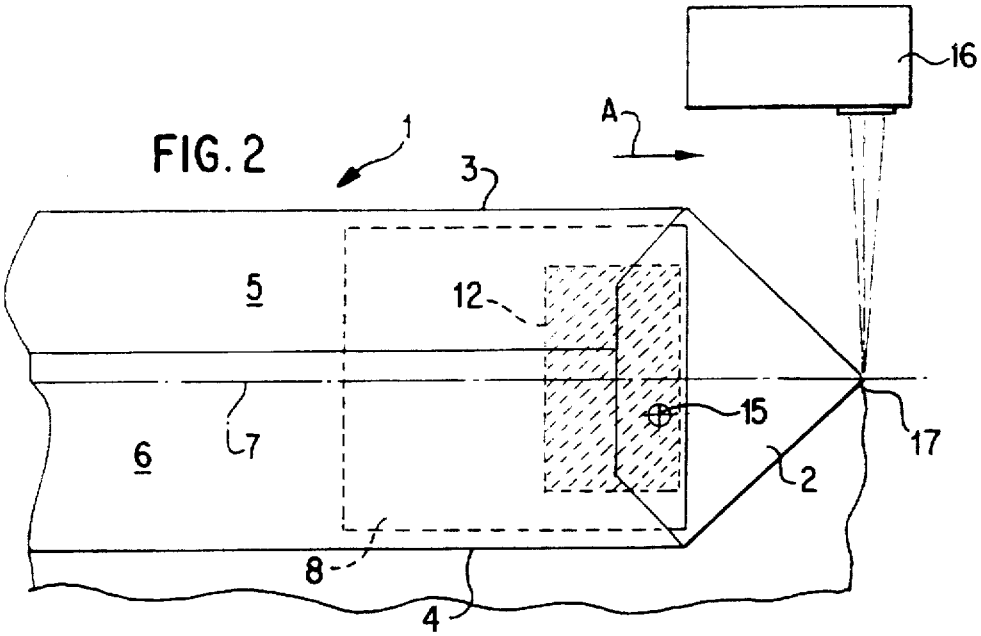
FIG. 2 is a top view of that same end of the closed bottom of the cross bottom valve sack of FIG. 1.

The sack bottom 1 shown in FIG. 1 and FIG. 2 has been formed in the usual manner by the opening-out of one end of a continuously conveyed sack blank in the form of a tubular section. In this opening-out action, as shown in FIG. 2 two corner folds 2, defined by diagonal fold lines at the bottom corners of the sack blank, are formed into the shape of isosceles triangles by this opening out.

Figure 3:
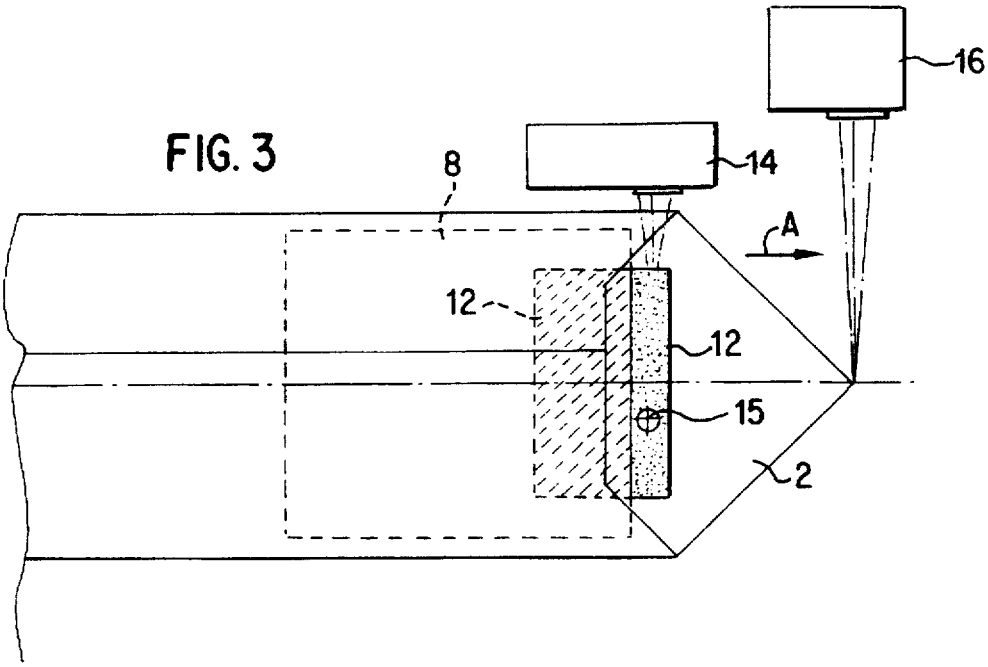
FIG. 3, corresponding to FIG. 2, is a representation of the same end of the sack bottom, wherein the valve tube has been displaced inwards in a faulty manner, so that this sack must be eliminated because of a faulty arrangement of this valve, and further showing the first and second photocell devices schematically.

Laterally outside the subsequent fold lines 3, 4 around which the side flaps 5, 6 are folded with a mutual overlap, these corner folds 2 were provided with cuts which are parallel to the median line 7 of the sack blank and which extend from the blank end as far as the fold lines of the corner folds 2 so that, as shown in FIGS. 2 and 3, the inner edges (defined in part by these cuts) of the folded-in corner folds 2 have a trapezoidal shape.

Valve leaves or valve tube sections 8 are tacked onto the corner folds 2 by deposits of adhesive while the bottom has not yet been closed. In FIGS. 2 and 3, such valve tube sections 8 are shown in dashes, and in FIG. 1 in solid lines. If valve leaves are tacked onto the still open bottoms, the leaves are closed into a valve tube only when the side folds 5, 6 are folded in with a mutual overlap.

FIG. 2 shows a sack bottom which is provided with a valve tube 8 glued-in in its correct position.

To check that the valve tube has been correctly arranged in its right position in the sack bottom, the corner fold 2 is provided with a rectangular black or dark coloured field 12 which is shown hatched in FIG. 2. As shown in FIG. 3, it is a sign that the valve tube 8 has not been glued-in in its correct position if the valve tube 8 does not entirely cover the field 12 which defines a mark.

For registering the incorrect position of the glued-in valve tubes, there is a first reflecting photocell device 14 directed, as shown in the drawing, towards the front edge of the rectangular mark 12 arranged on the corner fold 2. In this arrangement, at the time when it is activated, the photocell device 14 registers the point 15 on the sack bottom 1.

The photocell device 14 is activated by the second photocell device 16 which, in the embodiment shown, registers the tip 17 of the sack bottom leading in the transport direction A.

As soon as this second photocell device 16 has registered the tip 17 of the sack, it activates the first photocell device 14 which, if this latter registers the dark mark 12 as shown in FIG. 3, will then generate a defect signal on the basis of the predetermined interspacing of the two photocell devices.

However, if as shown in FIG. 2, the beam of the first photocell device 14 strikes the surface of the valve tube, no defect signal is generated.

We claim:

1. A method for checking a correct position of a valve leaf in the manufacture of cross bottom valve sacks, comprising the steps of:

arranging a cross bottom valve sack blank having a pair of side folds and a pair of corner folds such that said side folds are open and said corner folds are exposed;

providing one of the corner folds with a mark located such that said mark is covered by a valve leaf when the valve leaf is attached to said one of the corner folds in a correct position and such that at least a portion of said mark is exposed when the valve leaf is attached to said one of the corner folds in an incorrect position;

attaching said valve leaf to said one of the corner folds such that said valve leaf will form a tube communicating an inside of the sack with an outside of the sack after said side folds of the sack blank have been folded in;

scanning said one of the corner folds with a scanner to detect whether said portion of said mark is exposed;

eliminating sacks in which said scanner detects said portion of said mark in the scanning step.

2. A method according to claim 1, further comprising the steps of:

detecting with a detector said sack blank having said valve leaf attached as said sack blank moves through an assembly line;

activating said scanner to initiate said scanning step when said detector detects said sack blank in said detecting step.

3. A method according to claim 2, wherein said detector comprises at least one photocell device.

4. A method according to claim 2, wherein said detector is a mechanical feeler.

5. A method according to claim 1, wherein said scanner comprises at least one photocell device.

6. A method according to claim 5, wherein said at least one protocell device is a reflecting photocell device.

7. A method according to claim 1, wherein said mark is a color mark.

8. A method according to claim 7, wherein said color mark is a black field.

9. A method for checking a correct position of a valve leaf in the manufacture of cross bottom valve sacks, comprising the steps of:

(a) opening out ends of continuously transported tubular sections to form bottom squares or rectangles with triangular corner folds lying opposite each other; and (b) tacking a valve leaf onto one side of an opened out sack bottom, wherein after side folds of the opened-out sack bottom have been folded-in with a mutual overlap, the valve leaf forms a tube leading into an inside of the sack, and comprises an outer end freely accessible at one side of the sack bottom;

(c) providing one of the valve leaf and a portion of the corner fold which is covered by the valve leaf when the valve leaf is tacked in a correct position, with at least one mark for registering by a first photocell device fixed to the frame;

(d) activating the first photocell device by a reference pulse when the sack bottom has reached a predetermined position to be checked; said reference pulse being produced by a second photocell device that detects a tip or side edge of the sack bottom, a different edge of the sack bottom, or a mark on the corner fold, and (e) eliminating sacks with the valve leaf in an incorrect position.

10. A method according to claim 9, wherein at least one of the photocell devices is a reflecting photocell device.

11. A method according to claim 9, comprising a plurality of said photocell devices for registering the at least one mark indicating the correct position of the valve leaf.

12. A method according to claim 9, wherein the reference pulse is generated by a control unit.

13. A method according to claim 9, wherein said second photocell device is a reflecting photocell device.

14. A method according to claim 9, wherein the portion of the corner fold covered by the valve leaf in the correct position thereof is provided with a colour mark.

15. A method according to claim 8, wherein said colour mark is a black field.

* * * * *